US005213116A

United States Patent [19]

Stein

[11] Patent Number: 5,213,116

[45] Date of Patent: May 25, 1993

[54] BANG CUTTER

[76] Inventor: Sabrina R. Stein, 435 Locust St., #7, San Francisco, Calif. 94118

[21] Appl. No.: 850,184

[22] Filed: Mar. 11, 1992

[51] Int. Cl.[5] ..... A45D 24/34; B26B 19/22

[52] U.S. Cl. ..... 132/213.1; 30/195; 132/200

[58] Field of Search ..... 132/213, 213.1, 214, 132/148, 144, 200; 30/195, 227, 240, 241

[56] References Cited

U.S. PATENT DOCUMENTS

| | | | |
|---|---|---|---|
| 1,440,015 | 12/1922 | Kaniefski | 132/148 |
| 2,539,198 | 1/1951 | Metzler | 132/45 |
| 3,562,907 | 2/1971 | Greenberg | 30/240 |
| 4,275,500 | 6/1981 | Speer et al. | 30/240 |
| 4,505,283 | 3/1985 | Pischdotchian | 132/213.1 |
| 4,867,184 | 9/1989 | Davis | 132/214 |
| 5,012,830 | 5/1991 | Vaccaro et al. | 132/213.1 |

FOREIGN PATENT DOCUMENTS

| | | | |
|---|---|---|---|
| 338244 | 10/1989 | European Pat. Off. | 132/214 |

*Primary Examiner*—John G. Weiss

*Attorney, Agent, or Firm*—Graham & James

[57] ABSTRACT

A device for trimming bangs having a comb sleeve into which fits a primary comb for combing and holding the bangs in position against a cutting surface. The cutting surface and sleeve may form a single structure which is placed against the forehead and held in position by the user with an attached handle. A rotatable cutting blade travels along the cutting surface to cut the bangs.

31 Claims, 4 Drawing Sheets

BANG CUTTER

BACKGROUND OF THE INVENTION

This invention relates to devices useful in hairstyling and in particular to devices useful for cutting bangs.

Many persons incur the expense of visiting a hairstylist to get their bangs trimmed even though a complete haircut is unnecessary. The hairstylist has the training and proper type of shears to do an even trim without damaging the hair. The individual who visits the professional hairstylist therefore has a well groomed and neat appearance.

However, the required trip to the hairstylist can be expensive and time consuming. Although one could attempt to trim their own bangs at home, one could not be assured of cutting in a straight line due to the difficulty of cutting one's own hair. In addition, hair can be damaged by shredding. Shredding rather than cutting occurs when the scissors are not held at a proper angle. Holding scissors at a proper angle is difficult across the arcuate surface of the brow. Furthermore, while it is possible to have a friend or family member do the trimming to save expenses, this person is also not likely to have the proper skill to do a professional looking job, nor is it always possible to find a person willing to perform this task.

SUMMARY OF THE INVENTION

The bang cutter of the present invention provides individuals with a way to cut bangs neatly and evenly in their own homes without damaging the hair. The present invention provides a clean cut over the arcuate surface of the brow. The time and expense of visiting a hairstylist are thereby avoided. The present invention may be used unassisted by the person whose hair is to be cut or by a second individual. The present invention is thus very advantageous for parents of small children. The parent can use the present invention to give the child a trim thereby saving money and avoiding the difficulties of coaxing a child to the hairdresser.

DESCRIPTION OF THE PREFERRED EMBODIMENT

Figure 1:
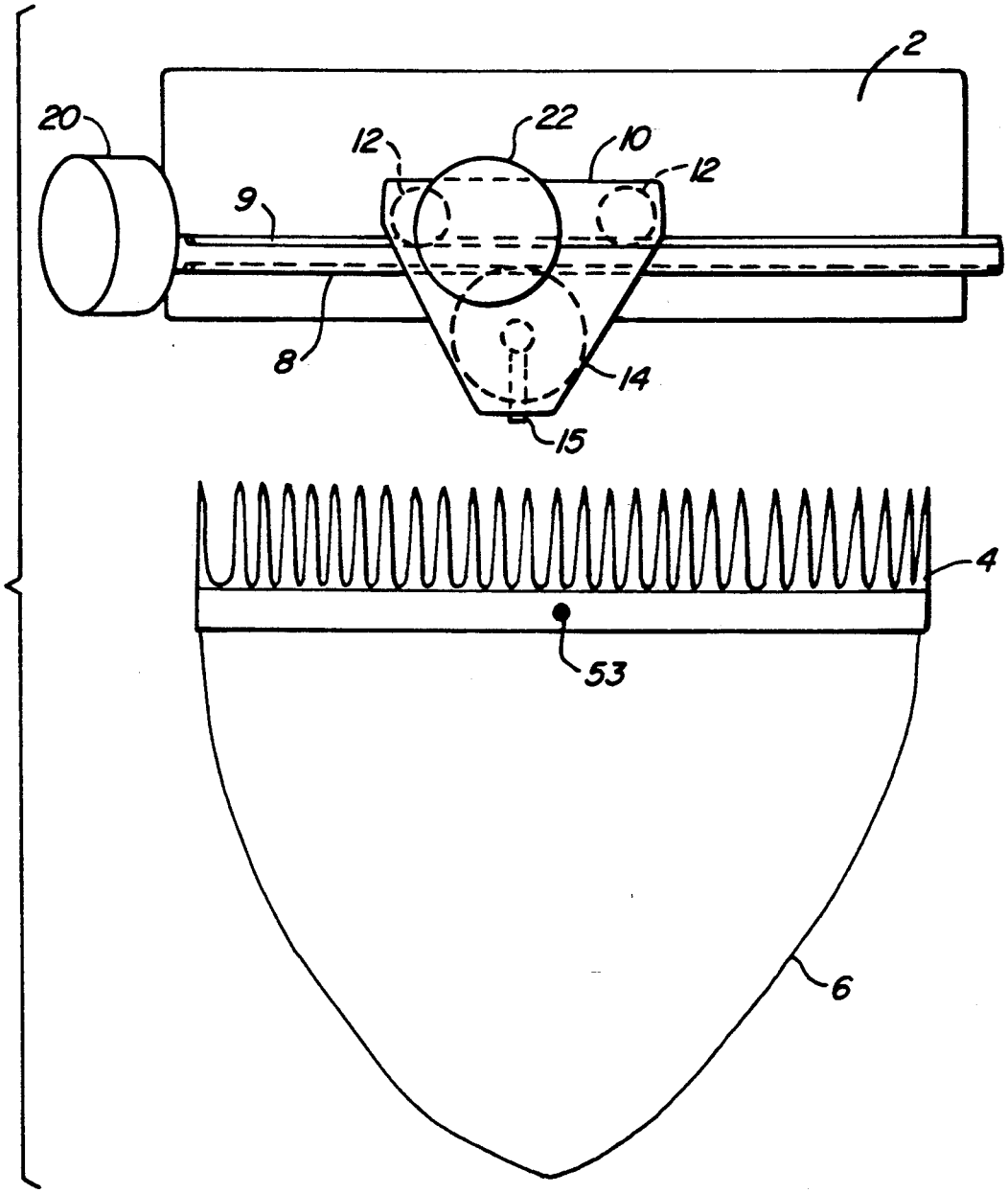
FIG. 1 is a front view of a bang cutter according to an embodiment of the present invention in which the peripheral sharp edge of a cutting wheel rolls on top of a flat surface to cut hair located therebetween.

FIG. 1 is a front view of a bang cutter according to an embodiment of the present invention. The bang cutter comprises a comb sleeve 2 into which fits primary comb 4. Primary comb 4 has a wire handle 6. Both sleeve 2 and primary comb 4 may be arcuate to better correspond to the shape of the forehead.

Located along the outside of sleeve 2 is a curved cutting blade 8 that on one side has a hardened cutting surface. Although the hardened surface of the blade 8 comprises hardened steel in this embodiment, surface 8 may be formed of other materials suitable for use as a cutting surface and known to those of skill in the art. A carriage 10, rides along a guide rail 9 formed integrally with blade 8. Carriage 10 is maintained in guide rail 9 on one side by a pair of rollers located on one side of carriage 10 and by a rotary cutting wheel 14 rotatably located on the other side of carriage 10 and biased against the hardened surface side of the guide rail 9 by an adjustment screw 15. Pressure from the adjustment screw 15 retains carriage 10 in place on guide rail 9 and permits pressure adjustment to accommodate various hair types. A groove located on the side of guide rail 9 in which the pair of rollers run, ensures that the carriage follows the curve of the guide rail and does not fall off as it is pulled along.

In the embodiment shown in FIG. 1, the axis of cutting wheel 14 is parallel to the hardened surface of blade 8. The cutting edge of cutting wheel 14 therefore presses perpendicularly down onto the hard surface of blade 8. As carriage 10 is pulled along the guide rail by a handle 22, cutting wheel 14 rolls along on the hard surface. As the pressurized sharp edge of wheel 14 rolls over the hair on the hard surface, any hair located between wheel 14 and the surface will be cut.

The extending hair ends are not firm but flimsy and are easily pushed away by the cutting wheel as it rotates. The hair may therefore be cut too long or not at all, resulting in a tattered cut. To maintain the bang hair in a proper position to be cut, a combination of primary comb 4 and comb sleeve 2 is utilized. As comb 4 is pressed up into sleeve 2, the hair is positioned in a thin, flat sheet, that is firmly held close to the cutting location, directly over the cutting blade 8.

Figure 2A:
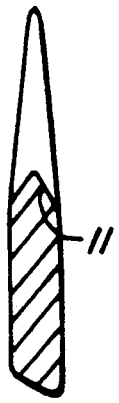
FIG. 2A. PRIOR ART
FIG. 2A is a cross-sectional view of a prior art conventional comb.
Figure 2B:
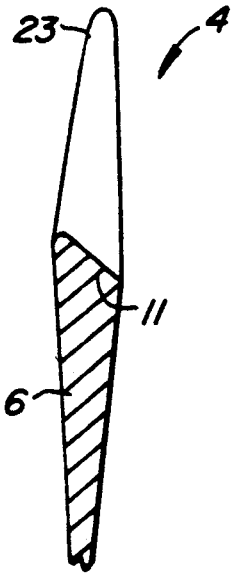
FIG. 2B is a cross-sectional view of a primary comb according to an embodiment of the present invention.

FIG. 2B shows a cross section of a primary comb 4 according to an embodiment of the present invention in which a profile of a tooth 23 may be seen. FIG. 2A shows a conventional comb. Tooth 23 of FIG. 2B is attached to wire handle 6 at the base 11 of comb 4. The front of comb 4 is furthest from the user and the back of comb 4 is closest to the user. As seen in FIG. 2B, the base 11 is slanted making the front of tooth 23 shorter than the back portion of tooth 23. In the conventional comb of FIG. 2A, base 11 is not slanted. Making the front of the tooth shorter than the back ensures that the hair is held at a location that is as close to the cutting location as possible, and to more easily direct the frail hair ends into the small area where the actual cutting action takes place.

Figure 3:
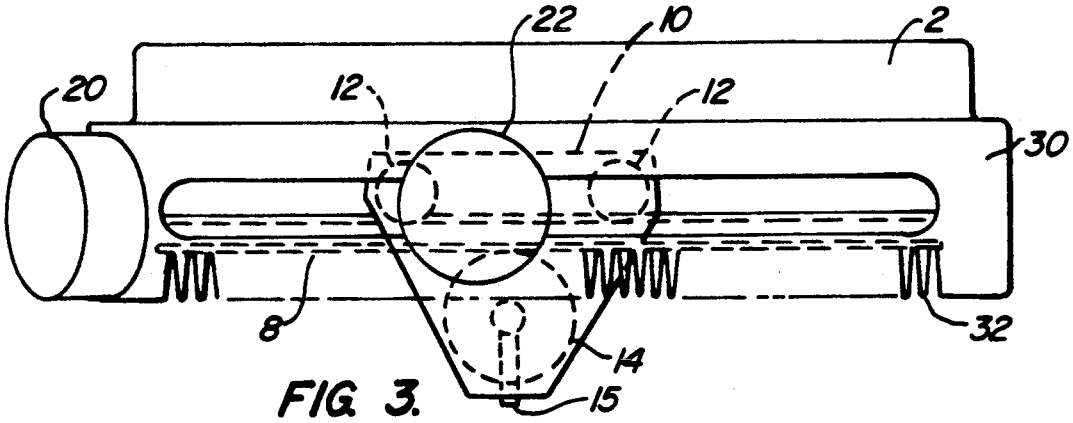
FIG. 3 is a front view of a bang cutter according to an alternate embodiment of the present invention utilizing the same cutting method as shown in FIG. 1, but including an inverted comb sleeve on the upper portion of the bang cutter.

FIG. 3 shows an alternate embodiment of the present invention employing the same cutting mechanism depicted in FIG. 1. In this embodiment, cutting surface 8 and a portion of carriage assembly 10 are located inside a housing 30 located on a front portion of sleeve 2. Handle 20 is also located on an outside surface of housing 30. Housing 30 serves to provide a more aesthetic appearance to the bang cutter and also protects the blade and cutting mechanisms. Housing 30 may also be equipped with a secondary comb 32. Secondary comb 32 is located on the free end of the hair and traps the hair ends against the side force derived from cutting wheel 14 as it moves over the blade. Secondary comb 32 thus stiffens the hair ends and retains the hair in place so it may be cut more accurately.

Figure 4:
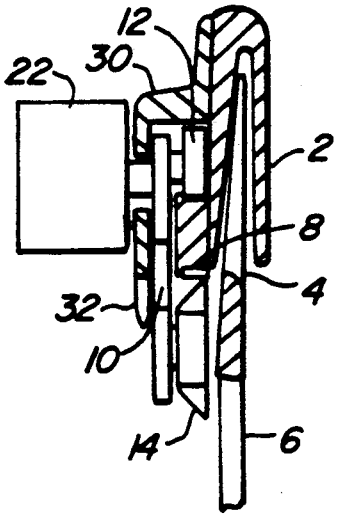
FIG. 4 is a cross-sectional view of a bang cutter according to yet another embodiment of the present invention.

FIG. 4 is a side view of a bang cutter having the same cutting mechanism as FIG. 1 and FIG. 3 and having an inverted comb sleeve 2. Secondary comb 32 and housing 30, as described in the embodiment of FIG. 3, may also be seen.

Figure 5:
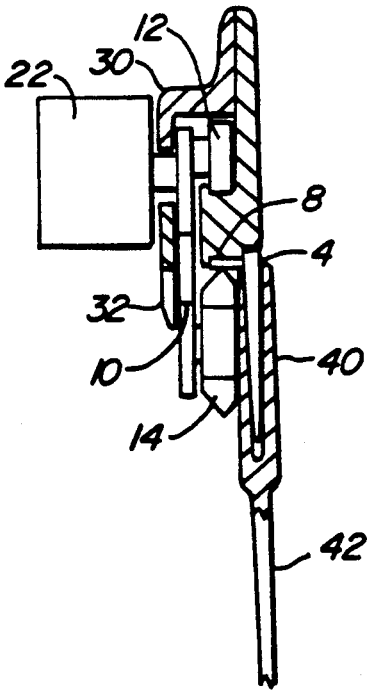
FIG. 5 is a cross-sectional view of the bang cutter of FIG. 1 but including a comb hanging down from the upper portion of the bang cutter and a hand-held comb sleeve adapted to be pushed up onto the comb during use.

FIG. 5 is a cross-sectional view of yet another alternate embodiment of the bang cutter of the present invention. The cross section of FIG. 5 differs from the cross section shown in FIG. 4 in that primary comb 4 is part of the overall bang cutter structure and is not a discrete piece as shown in FIG. 1. In the embodiment of FIG. 5, a comb sleeve 40 is attached to a wire handle 42 and is a discrete part. The sleeve 40 fits over primary comb 4.

Figure 6A:
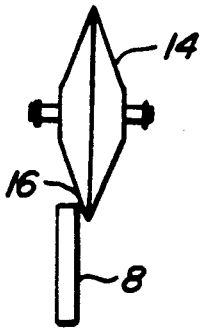
FIG. 6A is a side view of a blade mechanism according to an embodiment of the present invention in which the side of the cutting wheel rolls against an outer edge of a cutting plate.
Figure 6B:
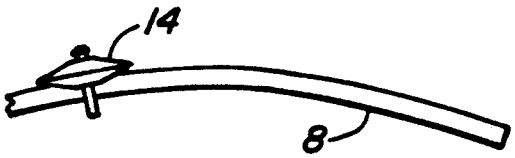
FIG. 6B is a top view of a blade mechanism according to an embodiment of the present invention.

FIG. 6A is a side view and FIG. 6B is a top view of an alternate blade construction. In FIG. 6 the wheel side presses against the sharp edge 16 of blade 8 and cuts hair located therebetween. To enable the hair to be cut against the arcuate blade, rotating cutting wheel 14 has a beveled side located against the sharp edge 15 of the curved cutting blade 8.

Figure 7:
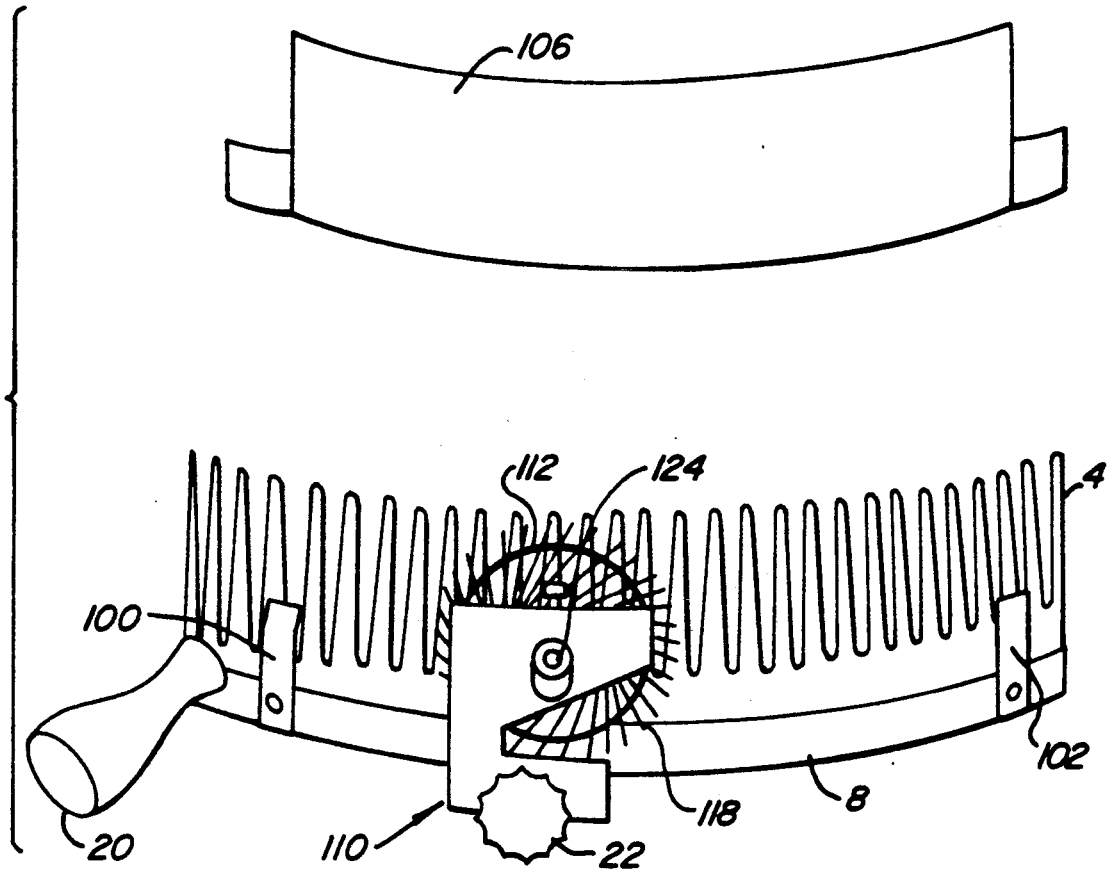
FIG. 7 is a front view of a bang cutter supplied with guide bristles to guide extending hair ends into the cutting area according to another embodiment of the present invention.
Figure 8A:
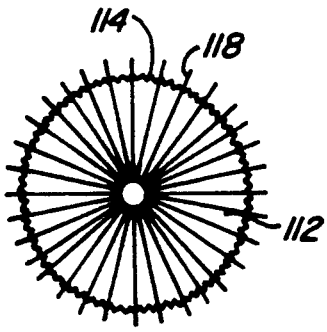
FIG. 8A is a front view of a cutting wheel having serrations according to an embodiment of the present invention.
Figure 8:
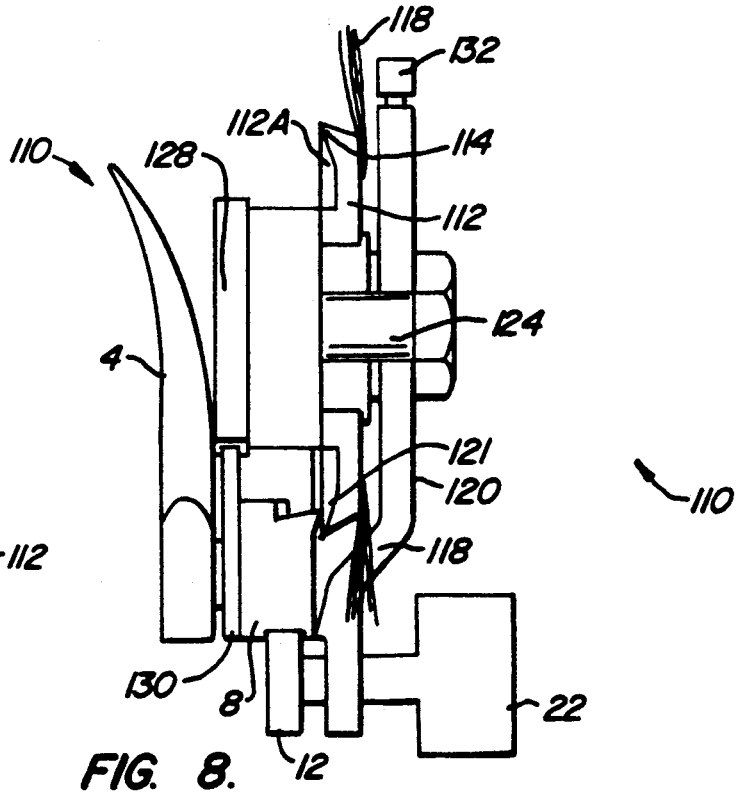
FIG. 8 is a cross-sectional view of the cutting blade assembly showing the location of the bristles radially on the cutting wheel and having a rack and pinion gear according to an alternate embodiment of the invention.

FIGS. 7–8 describe additional alternate embodiments of the present invention. FIGS. 7 and 8 are shown with the blade construction of FIG. 6. However, the embodiment of FIGS. 1, 3–5 and 7–8 may be constructed with the blades of either FIG. 1 or FIG. 6. In FIG. 7, primary comb 4 is formed integral with the apparatus. A pair of clips 100 and 102 are located on the front of the device for holding a shield 106. Shield 106 may be formed of clear plastic. Clips 100 and 102 not only hold shield 106 onto the body but lock in above shield 106 to hold it tight against cutting blade 8 and trap the hair firmly therebetween as the hair is cut. In the embodiment of FIG. 7, the cutting wheel 112 rides on the side of the cutting blade 8 creating a scissor-like effect to cut the hair. The structure of carriage 110 is now explained with reference to FIGS. 7 and 8.

FIG. 8 is a side, cross-sectional view of carriage 110 having cutting wheel 112 with serrated teeth 114. FIG. 8A contains a detailed view of cutting wheel 112 showing serrations 114. Serrated teeth 114 help grip the hair so that it can be cut by the blade. A non-serrated wheel tends to "push" the hair along cutting surface 8 resulting in an uneven cut. Wheel 112 is ground with a hollow cone 112A, giving it a concave configuration on the side facing the cutting blade, to permit it to follow the curved edge of the cutting blade. Located along the outside of wheel 112 are bristles 118. Bristles 118 help grab the hair as the blade assembly travels on surface 8. The wheel 112 is approximately an inch and a half in diameter. This size is found to provide good leverage in cutting the hair as carriage 110 travels along surface 8.

Carriage 110 in this embodiment is supplied with two rollers spaced apart on one side of the guide rail and one central roller on the other side, riding in guide slots to maintain the carriage on the guide rail. Carriage 110 may be tilted in the direction of travel instead of being tangential to the cutting blade so that the cutting edge of the wheel is certain to contact the cutting edge of the blade.

Wheel 112 is secured within carriage 110 by an outer plate 120 having guide wheels 12 on a lower portion thereof to allow the assembly to travel the length of cutting surface 8. A pressure roller 122 also travels along a top portion of cutting surface 8 and is secured to wheel 112 and plate 120 through bolt and bearing assembly 124. Pressure roller 122 has a separate ball bearing and is of a different diameter than wheel 112. The separate bearing structure and different diameter allow pressure roller 122 to rotate independently from wheel 112. The pressure exerted against the hair by the blade may be adjusted as described above using adjustment screw 132.

Carriage 110 may also comprise a gear 128 and a gear rack 130 to assist in moving carriage 110 along surface 8. Gear 128 and rack 130 aid in providing uniform motion along surface 8 and in eliminating the uneven motion caused by moving the user's forearm in an arc while accelerating carriage 110 along arcuate surface 8.

Note that in FIG. 8, the upper portion of the teeth of comb 4 angles away from the remainder of cutting assembly 110. This angle assists in gripping and holding the hair in place.

Figure 9:
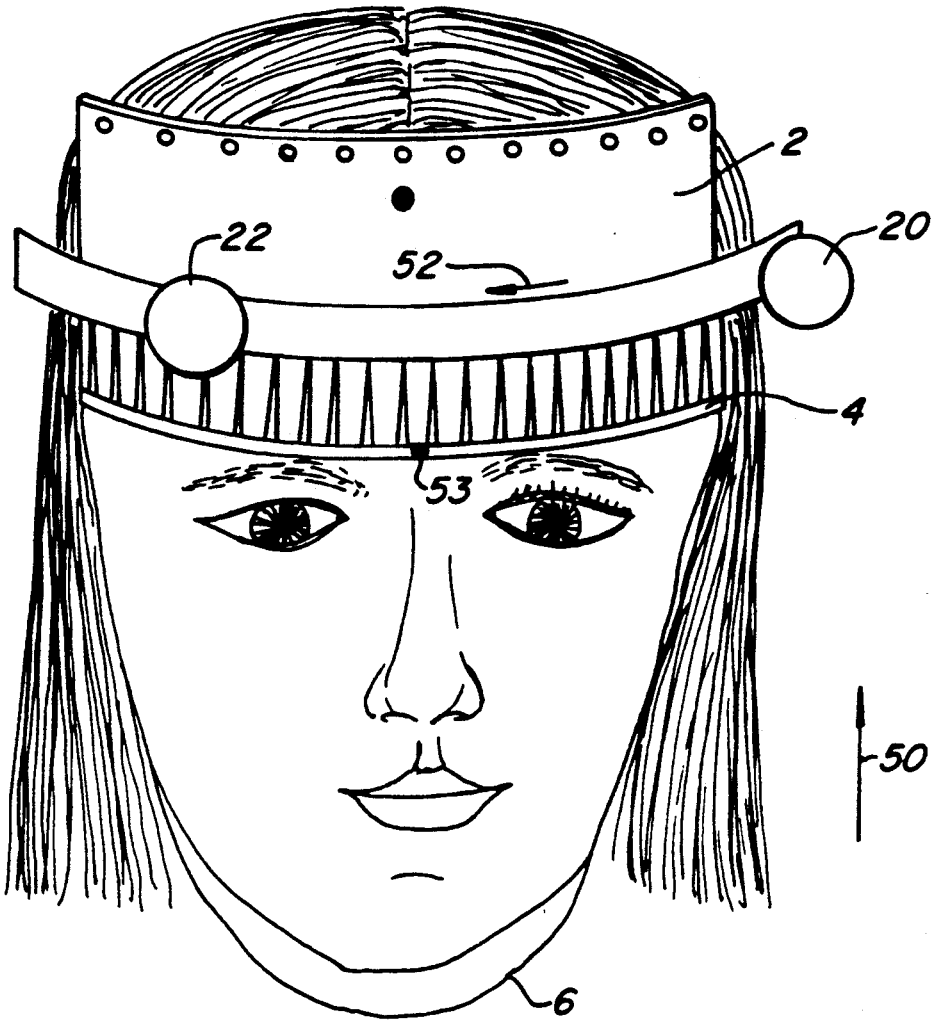
FIG. 9 is a front view of an individual using a bang cutter according to an embodiment of the present invention.

FIG. 9 is a front view of an individual using an embodiment of the bang cutter of the present invention as described in FIG. 1. To cut bangs, the user first aligns the bang cutter on the forehead at the location the bangs are to be cut. The user aligns the bang cutter and maintains it in the desired position by clasping handle 20.

After the user has positioned the bang cutter, the user then combs the bangs using primary comb 4 by combing in the direction of arrow 50. Primary comb 4 may also contain a colored dot or stud 53 in the center of the comb base to align the comb/cutter device with the facial features. If straight bangs are desired, the user inserts primary comb 4 completely into sleeve 2. If wispy bangs are desired, primary comb 4 is partially inserted into sleeve 2. The degree of graduation varies according the position of primary comb 4 and the tastes of the user.

Figure 10:
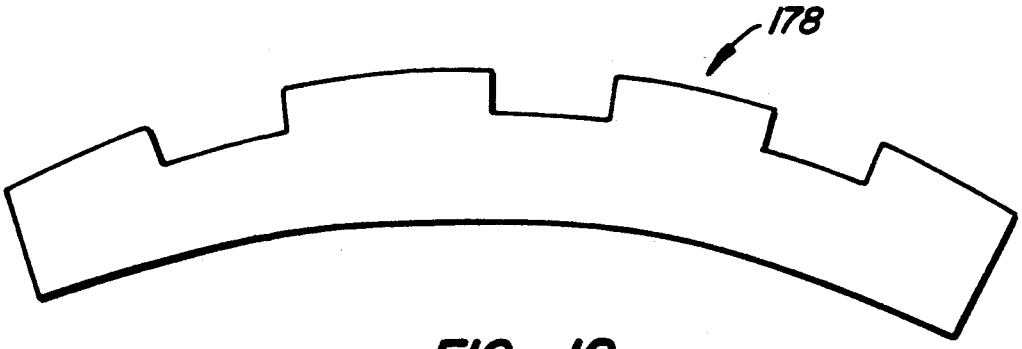
FIG. 10 is a view of a cutting blade useful for shaping the bangs according to an alternate embodiment of the invention.

Alternatively, if wispy bangs are desired, a different cutting blade 178, as seen in FIG. 10 is located on the device. The new has notches located in the cutting edge according to the cut desired. The cutting blades are readily interchangeable.

Once comb 4 is in the desired position, the user grasps handle 22 and handle 20, as seen in FIG. 9, and slides carriage 10 along cutting surface 8 in the direction of arrow 52. The sliding motion rotates rotating cutting wheel 14 cutting the bangs. Since the cutting operation involves pulling handles 20 and 22 away from each other, the device may be equally well operated by right and left-handed users.

To use the embodiment described in FIGS. 7 and 8, the user grasps handle 20 and combs the bang hair up with comb 4. When the hair and cutter mechanism are placed as desired, plastic shield 106 is clipped into place in front of comb 4 and held by clips 100 and 102. Once secured, shield 106 maintains the hair position in the bang cutter apparatus. With the hair in place, the user grasps handle 22 with the remaining hand, and accelerates carriage 110 along cutting surface 8. As blade 112 rotates, the hair is grasped by bristles 118 and serrated edges 114, enabling blade 112 to make an even and clean cut of the bangs. The bangs are completely cut upon one pass of carriage 110 and normally multiple passes of carriage 110 along cutting surface 8 are not required.

The front slot in the carriage must be properly positioned. The device shown in FIG. 8 will only cut the hair when moved from left to right. The hair must be able to slide all the way in the slot to where the cutting wheel 14 contacts the cutting blade 8. If carriage 110 in this configuration is moved from right to left, the straight left side of carriage 110 will force all the hair up and over the carriage and no hair will be cut. With carriage 110 attached with the slot cut positioned on the right or left side as desired by the operator the hair will be correctly cut. However, since the cutting operation is simply one of grasping the fixed handle 20 and the moveable handle 22 and pulling the two handles away from each other, it should not matter to the user which handle is held by which hand. Therefore, the same device can handled by both left-handed and right-handed persons.

Embodiments of the present invention, including the preferred embodiment, have now been described. Variations and modifications will be readily apparent to those of skill in the art. For these reasons, the invention should be construed in light of the claims.

What is claimed is:

1. A device for cutting bangs comprising:
an arcuate cutting blade;
a cutting assembly having a rotating cutting wheel wherein said wheel travels along said arcuate cutting blade and wherein said rotating cutting wheel traverses an arc; and
means for maintaining the bangs in position against said arcuate cutting blade.

2. The device for cutting bangs of claim 1 in which said wheel has a peripheral cutting edge and said blade has a cutting surface, said cutting edge being biased substantially perpendicularly toward said cutting surface.

3. The device for cutting bangs of claim 1 further comprising a handle attached to said cutting assembly.

4. The device for cutting bangs of claim 1 further comprising a centerline demarcation.

5. The device for cutting bangs of claim 1 wherein said rotating cutting wheel is approximately one and one-half inches in diameter.

6. The device for cutting bangs of claim 1 wherein said cutting edge of said rotating cutting wheel is serrated.

7. The device for cutting bangs of claim 1 wherein said rotating cutting wheel further comprises a pressure roller.

8. The device for cutting bangs of claim 1 wherein said arcuate cutting blade further comprises a series of indentations along a cutting surface of said arcuate cutting blade.

9. A device for cutting bangs comprising:
an arcuate cutting blade;
a cutting assembly having a rotating cutting wheel wherein said wheel travels along said arcuate cutting blade;
means for maintaining the bangs in position against said arcuate cutting blade; and
wherein said means for maintaining the bangs in position against said arcuate cutting blade includes:
a sleeve coupled to said arcuate cutting blade; and
a comb insertable into said sleeve.

10. A device for cutting bangs comprising:
an arcuate cutting blade;
a cutting assembly having a rotating cutting wheel wherein said wheel travels along said arcuate cutting blade;
means for maintaining the bangs in position against said arcuate cutting blade; and
wherein said means for maintaining the bangs in position against said arcuate cutting blade includes:
a comb having a base and a plurality of teeth wherein said base is connected to a concave position of said arcuate cutting blade; and
a shield, detachably coupled to said arcuate cutting surface for clamping the bangs within said comb and against said arcuate cutting blade.

11. The device for cutting bangs of claim 10 further comprising a clip for coupling said shield to said arcuate cutting blade.

12. The device for cutting bangs of claim 10 wherein said comb further comprises:
a plurality of teeth each of said teeth having a front portion and a rear portion; and
wherein said front portion of said teeth are shorter in length than said rear portion of said teeth.

13. The device for cutting bangs of claim 10 wherein said plurality of teeth are angled away from said rotating cutting wheel.

14. A device for cutting bangs comprising:
an arcuate cutting blade;
a cutting assembly having a rotating cutting wheel wherein said wheel travels along said arcuate cutting blade;
means for maintaining the bangs in position against said arcuate cutting blade; and
wherein said rotating cutting wheel further comprises a set of bristles located radially outward along a circumference of said rotating wheel.

15. A device for cutting bangs comprising:
an arcuate cutting blade having a first cutting edge;
a cutting assembly having a rotating cutting wheel wherein said wheel travels along said arcuate cutting blade and wherein said rotatably cutting wheel traverses an arc; and
said wheel having a second cutting edge adapted to cooperate with said cutting edge of said arcuate cutting blade to shear off hair locatable therebetween.

16. The device for cutting bangs of claim 15 wherein at least one side of said wheel containing said cutting edge is concave.

17. The device for cutting bangs of claim 15 further comprising a handle attached to said cutting assembly.

18. The device for cutting bangs of claim 15 further comprising a centerline demarcation.

19. The device for cutting bangs of claim 15 wherein said rotating cutting wheel is approximately one and one-half inches in diameter.

20. The device for cutting bangs of claim 15 wherein said second cutting edge of said rotating wheel is serrated.

21. The device for cutting bangs of claim 15 wherein said rotatable wheel further comprises a pressure roller.

22. The device for cutting bangs of claim 15 wherein said first cutting edge of said arcuate cutting blade further comprises a series of indentations.

23. A device for cutting bangs comprising:
an arcuate cutting blade having a first cutting edge;
a cutting assembly having a rotating cutting wheel wherein said wheel travels along said arcuate cutting blade;
said wheel having a second cutting edge adapted to cooperate with said cutting edge of said arcuate cutting blade to shear off hair locatable therebetween;
means for maintaining the bangs in position; and
wherein said means for maintaining the bangs in position further comprises:
a sleeve coupled to said arcuate cutting blade; and
a comb insertable into said sleeve.

24. A device for cutting bangs comprising:
an arcuate cutting blade having a first cutting edge;
a cutting assembly having a rotating cutting wheel wherein said rotating cutting wheel travels along said arcuate cutting blade;
said wheel having a second cutting edge adapted to cooperate with said cutting edge of said arcuate cutting blade to shear off hair locatable therebetween;
means for maintaining the bangs in position;
wherein said means for maintaining the bangs in position includes:
a comb having a base and a plurality of teeth wherein said base is connected to a concave portion of said arcuate cutting blade; and
a shield, detachably coupled to said arcuate cutting surface for clamping the bangs within said comb and against said arcuate cutting blade.

25. The device for cutting bangs of claim 24 further comprising a clip for coupling said shield of said arcuate cutting blade.

26. The device for cutting bangs of claim 24 wherein said comb further comprises:
a plurality of teeth each of said teeth having a front portion and a rear portion; and
wherein said front portion of said teeth are shorter in length than said rear portion of said teeth.

27. The device for cutting bangs of claim 24 wherein said plurality of teeth are angled away from said rotatable wheel.

28. A device for cutting bangs comprising:
an arcuate cutting blade having a first cutting edge;
a cutting assembly having a rotating cutting wheel wherein said wheel travels along said arcuate cutting blade;
said wheel having a second cutting edge adapted to cooperate with said cutting edge of said arcuate cutting blade to shear off hair locatable therebetween; and
wherein said rotating cutting wheel further comprises a set of bristles located radially outward along a circumference of said rotating cutting wheel.

29. A device for cutting hair bangs comprising:
a curved blade having a substantially flat upper surface, a concavely curved inner edge and a convexly curved outer edge;
a cutting assembly having a rotatable cutting wheel, said wheel having a peripheral cutting edge adapted to roll along said curved blade wherein said wheel traverses an arc;
means, coupled to said cutting assembly, for biasing said wheel against said blade; and
means for maintaining said bangs in a stationary position on said blade as said bangs are cut.

30. A method for cutting bangs comprising the steps of:
placing an arcuate cutting blade in proximity to a forehead;
positioning the bangs on said cutting blade;
moving a rotating cutting wheel along said arcuate cutting blade, wherein said rotating cutting wheel traverses an arc, at least where the bangs are positioned on said arcuate cutting blade and wherein the bangs are cut.

31. The method of cutting bangs of claim 30, wherein the step of positioning the bangs further comprises the steps of:
combing the bangs up onto the arcuate cutting blade; and
securing the bangs in position.

* * * * *